US007113145B1

(12) United States Patent
Noble

(10) Patent No.: US 7,113,145 B1
(45) Date of Patent: Sep. 26, 2006

(54) ANTENNA MOUNTING BRACKET ASSEMBLY

(75) Inventor: Myron C. Noble, South Bend, IN (US)

(73) Assignee: Valmont Industries, Inc., Valley, NE (US)

( * ) Notice: Subject to any disclaimer, the term of this patent is extended or adjusted under 35 U.S.C. 154(b) by 0 days.

(21) Appl. No.: 11/134,969

(22) Filed: May 23, 2005

(51) Int. Cl.
*H01Q 1/12* (2006.01)
*A47K 1/00* (2006.01)

(52) U.S. Cl. ..... 343/892; 343/890; 248/218.4

(58) Field of Classification Search ..... 343/878, 343/890, 891, 892; 248/218.4, 230.4
See application file for complete search history.

(56) References Cited

U.S. PATENT DOCUMENTS 5,787,673 A 8/1998 Noble ..... 52/726.1
5,835,068 A 11/1998 Paul et al. ..... 343/757
5,920,291 A 7/1999 Bosley ..... 343/892
5,926,151 A * 7/1999 Hagiwara et al. ..... 343/882
5,963,179 A * 10/1999 Chavez ..... 343/892
5,971,345 A 10/1999 Khalaf ..... 248/512
6,232,928 B1 5/2001 Zimmerman et al. ..... 343/882
6,262,691 B1 * 7/2001 Austin et al. ..... 343/890
6,283,425 B1 9/2001 Liljevik ..... 248/230.4
6,342,870 B1 1/2002 Mehrkens et al. ..... 343/891
6,361,007 B1 3/2002 Oby et al. ..... 248/285.1
6,452,567 B1 9/2002 Overton ..... 343/891
6,768,474 B1 7/2004 Hunt ..... 343/892

* cited by examiner

*Primary Examiner*—Tho Phan
(74) *Attorney, Agent, or Firm*—Thomte, Mazour & Niebergall; Dennis L. Thomte

(57) ABSTRACT

An antenna mounting bracket assembly is disclosed which enables an antenna to be secured to either a vertically disposed support member or an angularly disposed support member with the antenna being disposed in a vertical plane in either case.

9 Claims, 7 Drawing Sheets

ANTENNA MOUNTING BRACKET ASSEMBLY

BACKGROUND OF THE INVENTION

1. Field of the Invention

This invention relates to an antenna mounting bracket assembly and more particularly to a mounting bracket assembly which may be mounted on either a vertically disposed support member, structural member or leg as found in towers, or on a support member, structural member or leg which is inclined with respect to vertical due to the fact that the tower tapers inwardly at certain parts thereof. In either case, the mounting bracket assembly of this invention enables the antenna to be supported thereon so that it is disposed in a vertical plane.

2. Description of the Related Art

In many instances, antennas are mounted on towers which taper inwardly from the lower end thereof to the upper end thereof which results in some of the support legs of the towers being vertically disposed while some of the support legs are disposed at an angle with respect to vertical. When the antenna is mounted on a tower, the antenna must be disposed laterally of the tower by some sort of an antenna support means. If the antenna mounting bracket assembly is to be mounted on a support member or leg which is vertically disposed, the antenna supported thereon will be disposed in its desired vertical position if the mounting bracket assembly is rotated with respect to the support member. However, if the mounting bracket assembly is mounted on an angled or tapered support member or leg of the tower, if the supporting arm structure is rotated with respect to the angled support member, the antenna will not be vertically disposed. At the present time, a pipe mount with adjustable brackets must be utilized to take out the taper of the tower support member or leg in order to be able to rotate the antenna assembly without tilting the antenna assembly. This method is cumbersome and expensive.

SUMMARY OF THE INVENTION

An antenna mounting bracket assembly is provided for installation on either a first leg or support member which is angled with respect to vertical or on a second leg or support member which is vertically disposed. The bracket assembly of this invention comprises upper and lower mounting brackets which are mounted on the leg or support member. The upper mounting bracket includes a back portion, having upper and lower ends, and a top portion, having inner and outer ends, with the top portion extending generally transversely from the upper end of the back portion. The back portion of the upper mounting bracket is secured to one of the first and second legs or support members. The top portion of the upper mounting bracket has an inner bolt opening formed therein which is spaced from the inner end thereof a predetermined first distance. The top portion of the upper mounting bracket also has an outer bolt opening formed therein which is spaced from the inner end thereof a predetermined second distance.

The lower mounting bracket includes a back portion, having upper and lower ends, and a top portion, having inner and outer ends, with the top portion extending generally transversely from the upper end of the back portion. The top portion of the lower mounting bracket has an inner bolt opening formed therein which is spaced from the inner end thereof a predetermined third distance. The top portion of the lower mounting bracket also has an outer bolt opening formed therein which is spaced from the inner end thereof a predetermined fourth distance. The predetermined second and fourth distances are equal while the predetermined first distance is greater than the predetermined third distance. The back portion of the lower mounting bracket is secured to the same leg or support member as the upper mounting bracket but is positioned therebelow.

The bracket assembly also includes a pair of identical support arm assemblies which are reversible to eliminate the need for two different parts. For purposes of concise description and claiming, one of the identical support arm assemblies will be described as comprising first and second support arms joined by a bent brace while the other support arm assembly will be described as comprising third and fourth support arms joined by a bent brace. The inner ends of the first and third support arms are secured to the upper mounting bracket at the outer bolt opening thereof, when the upper mounting bracket is secured to the second leg. The first and third support arms extend outwardly from the upper mounting bracket in a diverging manner. The inner ends of the second and fourth support arms are secured to the lower mounting bracket at the outer bolt opening thereof, when the lower mounting bracket is secured to the second leg. The second and fourth support arms extend outwardly from the lower bracket in a diverging manner.

The inner ends of the first and third support arms are secured to the upper mounting bracket at the outer bolt opening when the upper mounting bracket is secured to a first leg which has a first angular relationship with respect to vertical. The inner ends of the second and fourth support arms are secured to the lower mounting bracket at the inner bolt opening thereof when the lower mounting bracket is secured to the first leg having the first angular relationship with respect to vertical.

The inner ends of the first and third support arms are secured to the upper mounting bracket at the inner bolt opening when the upper mounting bracket is secured to a first leg which has a second angular relationship with respect to vertical which is less than the first angular relationship. The upper ends of the second and fourth support arms are secured to the lower mounting bracket at the inner bolt opening thereof when the lower mounting bracket is secured to the first leg having the second angular relationship with respect to vertical which is less than the first angular relationship.

The outer ends of the first, second, third and fourth support arms are adapted to have an antenna support mounted thereon with the selective connection of the support arms to the mounting brackets enabling an antenna mounted on the antenna support to be substantially vertically disposed regardless of whether the mounting brackets are mounted on vertically disposed or angularly disposed legs.

A modified form of the support arm assembly is also disclosed wherein a single support arm extends outwardly from the upper mounting bracket and a single support arm extends outwardly from the lower mounting bracket.

It is therefore a principal object of the invention to provide an improved antenna mounting bracket assembly.

A further object of the invention is to provide an improved antenna mounting bracket assembly which enables an antenna to be mounted to either angularly disposed support members or vertically disposed support members with the antenna being vertically disposed in either scenario.

Still another object of the invention is to provide an improved antenna mounting bracket assembly which is economical of manufacture and durable in use.

These and other objects will be apparent to those skilled in the art.

DETAILED DESCRIPTION OF THE INVENTION

Figures 7A, 7B, 7C:
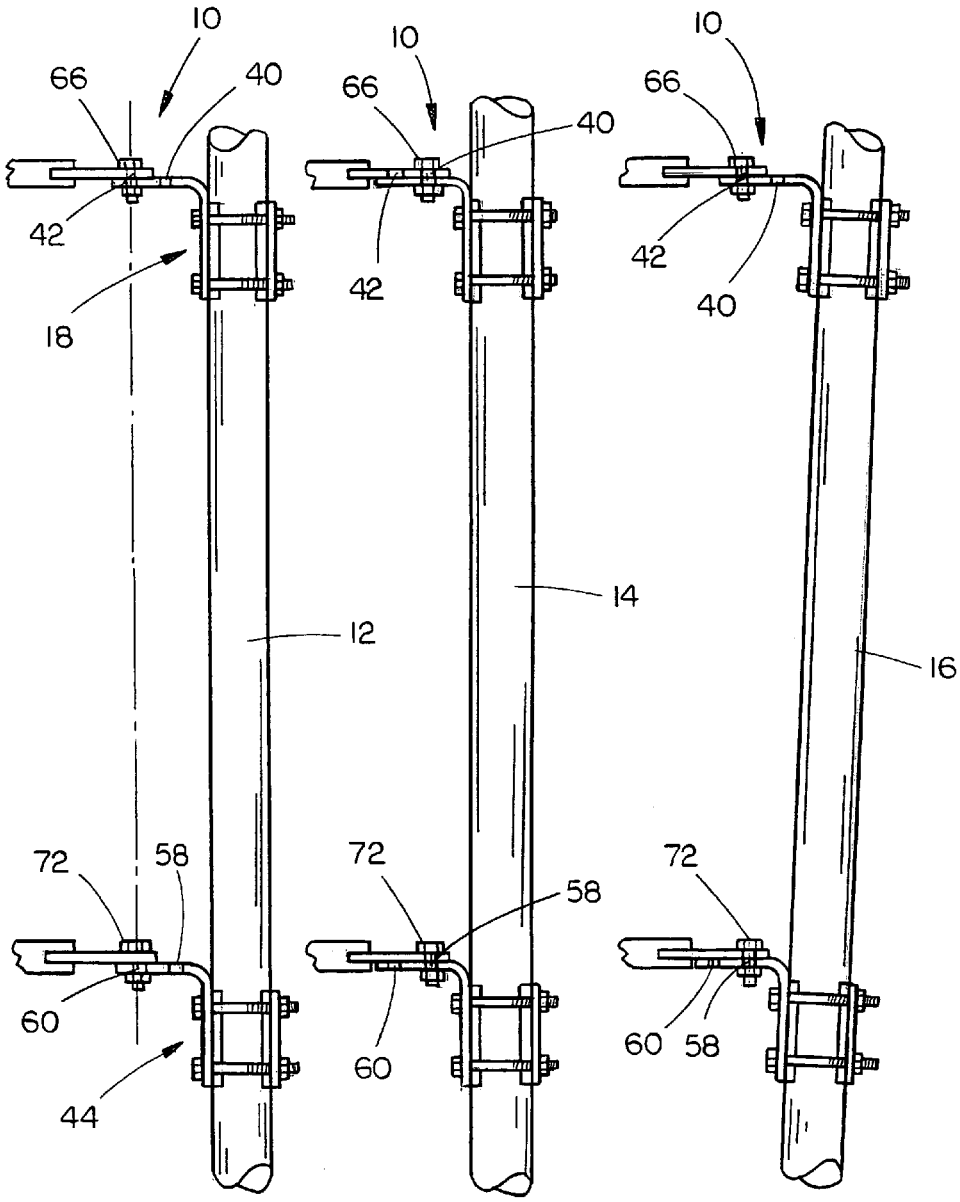
FIG. 7A is a side view illustrating the antenna mounting bracket assembly of this invention mounted on a vertically disposed leg.
FIG. 7B is a side view similar to FIG. 7A except that the antenna mounting bracket assembly is mounted on a leg which is inclined with respect to vertical.
FIG. 7C is a side view illustrating the antenna mounting bracket assembly of this invention mounted on a leg which is inclined with respect to vertical a greater amount than that shown in FIG. 7B.
Figure 8:
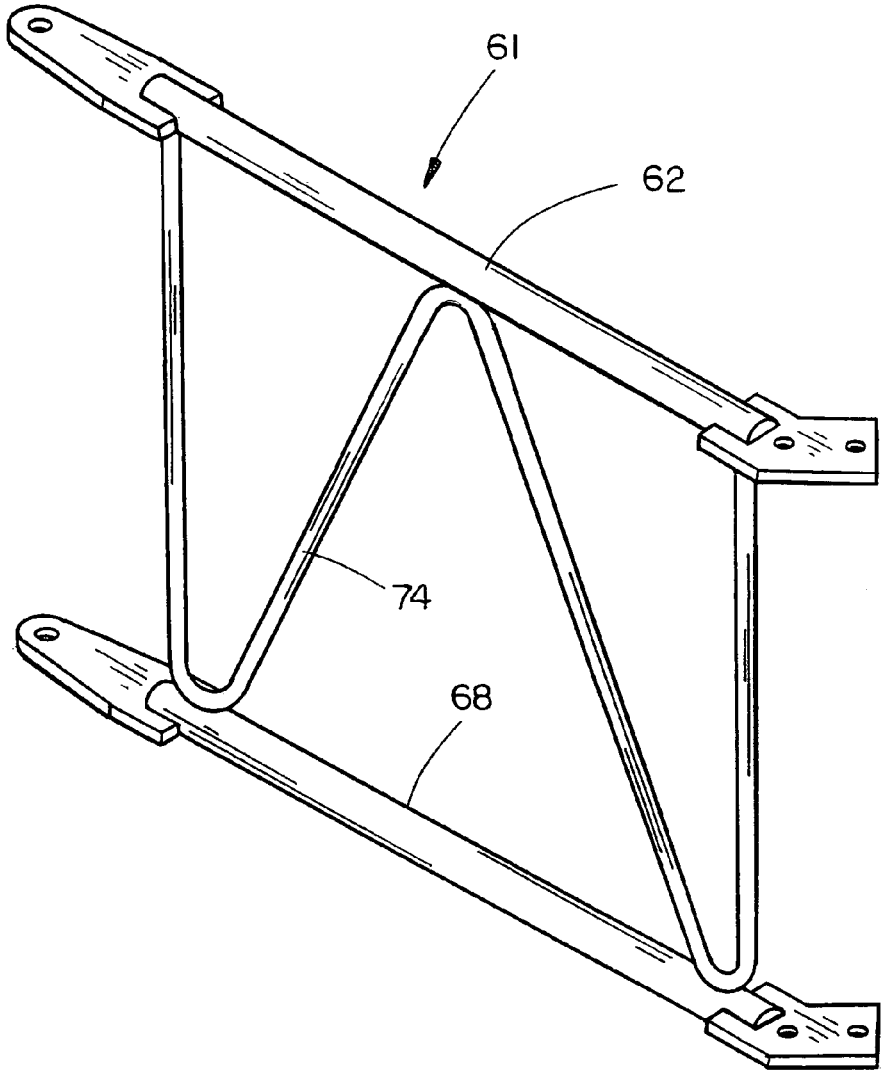
FIG. 8 is a perspective view of the support arm assembly.

The antenna mounting bracket assembly of this invention is referred to by the reference numeral 10. The assembly 10 is adapted to be mounted on a vertically disposed support member, structural member or leg such as found in a tower (FIG. 7A) so that the antenna will dwell in a substantially vertically disposed attitude. Further, the assembly 10 is also adapted to be mounted on a support member, structural member or leg which is inclined with respect to vertical due to the fact that the tower tapers inwardly at certain parts thereof (FIG. 7B). The assembly 10 may also be used with support members having different angular orientations with respect to vertical (FIG. 7C).

For purposes of description, the numeral 12 refers to a structural member, support member or leg which is vertically disposed (FIG. 7A), while the numeral 14 refers to a structural member, support member or leg which is inclined with respect to vertical, for example an inward taper of two feet in twenty feet (FIG. 7B). The numeral 16 refers to a structural member, support member or leg which is inclined with respect to vertical, for example, an inward taper of six inches in twenty feet (FIG. 7C). Hereinafter, the structural member, support member or leg will be simply referred to as a leg.

Mounting bracket assembly 10 includes an upper mounting bracket 18 which may be secured to the tower leg 12, 14 or 16. Bracket 18 includes a base portion 20 having a top portion 22 extending outwardly therefrom. Base portion 20 has an inner face 24 and an outer face 26. The inner face 24 of base portion 20 has a pair of rods 28 and 30 welded thereto to define a space 32 therebetween which receives a portion of the associated leg. Base portion 20 also has bolt openings 34 extending therethrough adapted to receive bolts 36 therein. The base portion 20 is positioned at the outer side of the leg and a clamp plate 38 is positioned at the inner side of the leg so that the bolts 36 may extend through bolt openings 37 formed therein to secure the bracket 18 to the associated leg.

Figure 5:
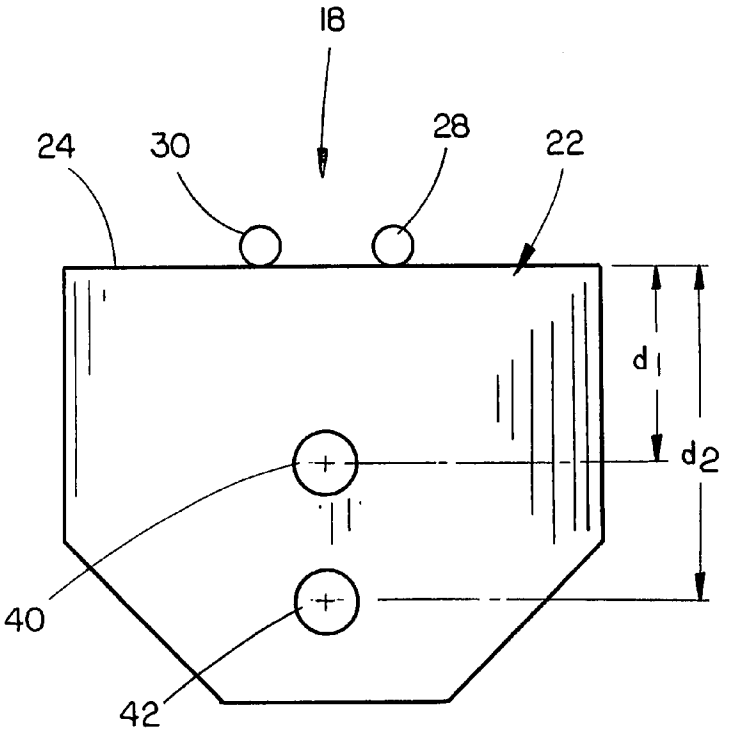
FIG. 5 is a top view of the upper mounting bracket.

Top portion 22 of bracket 18 has a bolt opening 40 formed therein which is spaced outwardly from the inner face 24 of base portion 20 a first predetermined distance d1 (FIG. 5). Top portion 22 also has a bolt opening 42 formed therein which is spaced outwardly from the inner face 24 of base portion 20 a second predetermined distance d2 (FIG. 5).

Figure 6:
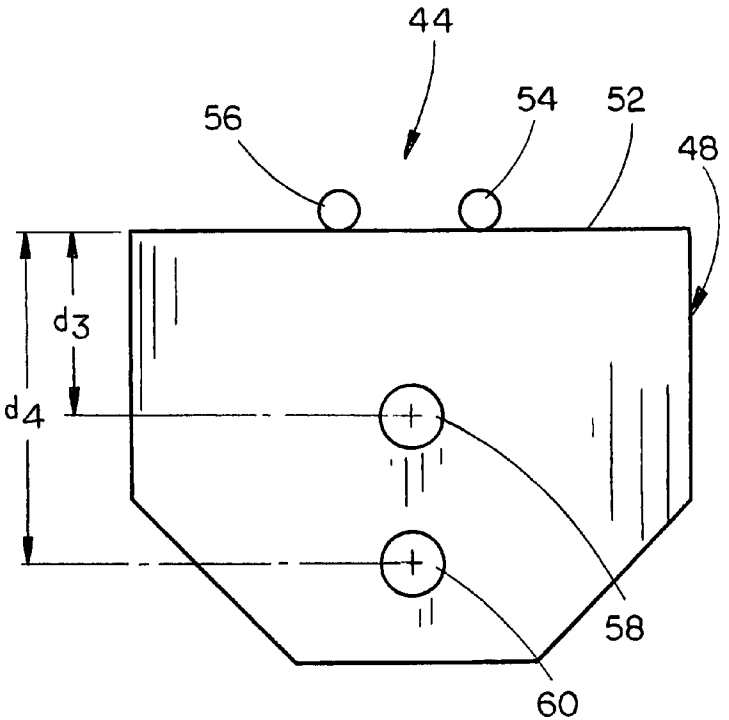
FIG. 6 is a top view of the lower mounting bracket.

The numeral 44 refers to a lower mounting bracket having a base portion 46 and a top portion 48. Base portion 46 has bolt openings formed therein adapted to receive bolts 50 therein which extend through clamp plate 51. The inner face 52 of base portion 46 has a pair of rods 54 and 56 welded thereto. Top portion 48 has a bolt opening 58 formed therein which is spaced outwardly of inner face 52 of base portion 46 a predetermined third distance d3 (FIG. 6). Preferably, the predetermined third distance is less than the predetermined first distance described above. In other words, the distance between the inner face 24 of base portion 20 of bracket 18 and the center of bolt opening 40 is greater than the distance between the inner face 52 of base portion 46 of bracket 44 and the center of bolt opening 58.

Top portion 48 of bracket 44 also has a bolt opening 60 formed therein which is spaced outwardly of inner face 52 of base portion 46 a predetermined fourth distance d4 (FIG. 6). Preferably, the predetermined fourth distance d4 is the same as the predetermined second distance d2. In other words, the distance between the inner face 24 of base portion 20 of bracket 18 and the center of bolt opening 42 is the same as the distance between the inner face 52 of base portion 46 of bracket 44 and the center of bolt opening 60.

A pair of identical and reversible support arm assemblies 61 and 61' extend outwardly from the mounting brackets 18 and 44 in a diverging relationship. For purposes of description, assembly 61 will be described as comprising vertically spaced support arms 62 and 68 having a bent brace 74 extending therebetween while assembly 61' will be described as comprising vertically spaced support arms 64 and 70 having a bent brace 76 extending therebetween. The outer ends of the support arms have angled mounting plates provided thereon while the inner ends thereof have pivot plates provided thereon. The support arm assemblies may be rotated 180° so as to be used at either side, thereby eliminating the need for two separate parts. The elongated support arms 62 and 64 are secured at their inner ends to the top portion 22 of upper mounting bracket 18 by means of a bolt 66 extending through bolt openings formed therein with the bolt 66 extending through either bolt opening 40 or bolt opening 42, as will be described hereinafter. A nut is secured to bolt 66 in conventional fashion.

The elongated support arms 68 and 70 are secured at their inner ends to the top portion 48 of lower mounting bracket 44 by means of a bolt 72 extending through bolt openings formed therein with the bolt extending through either bolt opening 58 or bolt opening 60, as will be described hereinafter. A nut is secured to bolt 74 in conventional fashion.

Figure 1:
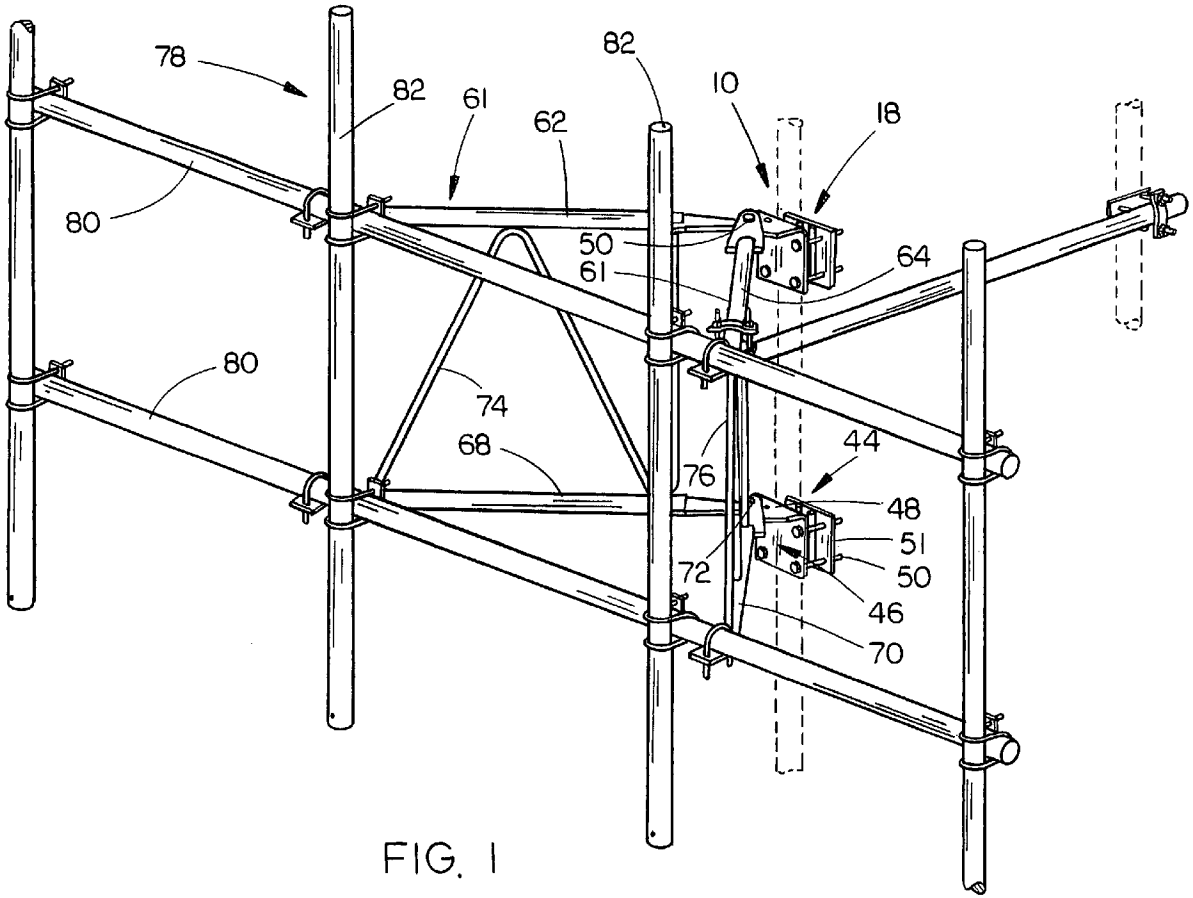
FIG. 1 is perspective view of the antenna mounting bracket assembly of this invention mounted on a tower leg.
Figure 2:
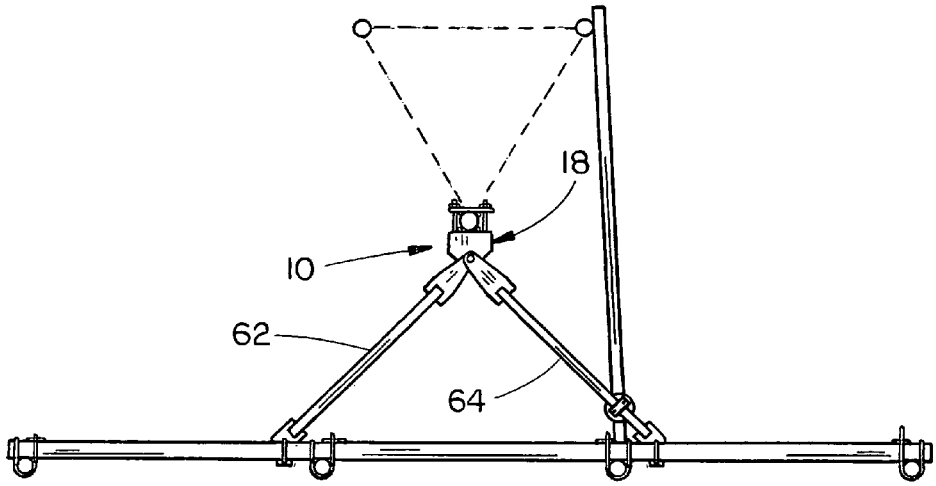
FIG. 2 is a top view of the antenna mounting bracket assembly of this invention.
Figure 3:
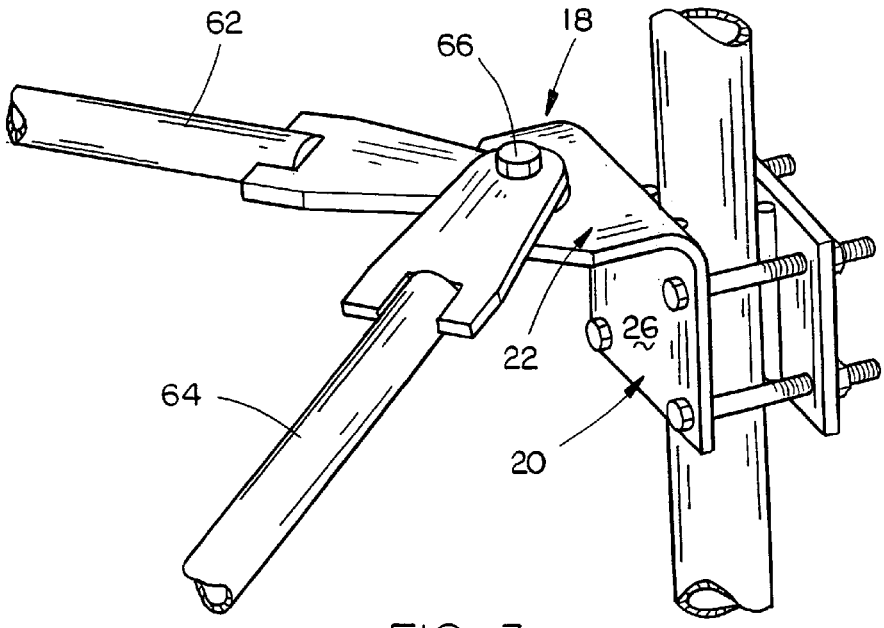
FIG. 3 is a partial perspective view of the upper mounting bracket of the assembly.
Figure 4:
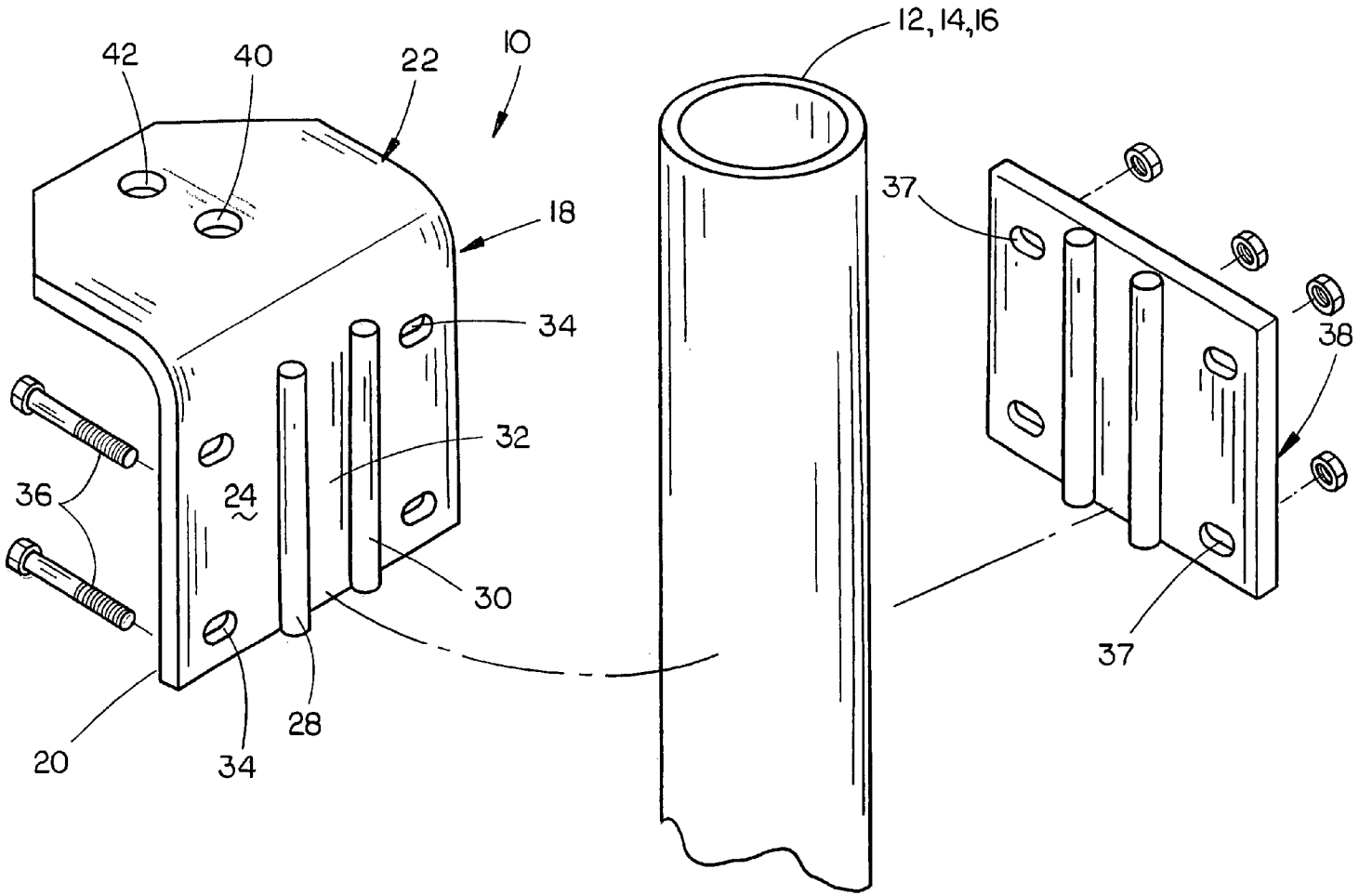
FIG. 4 is an exploded perspective view of the upper mounting bracket.

The bent brace 74 is secured to support arms 62 and 68 by welding and extends therebetween, as previously described. The bent brace 76 is secured to the support arms 64 and 70 by welding and extends therebetween, as also previously described. An upstanding antenna mounting pipe assembly 78 is secured to the outer ends of support arms 62, 64, 68 and 70 by U-bolts and includes a plurality of horizontally extending pipes 80 and a plurality of vertically extending pipes 82 which are joined together by U-bolts, as seen in FIG. 1. The assembly 78 may take various forms and does not form a part of the instant invention but which is designed to position the pipes 82 in a vertically disposed position or vertical plane regardless of whether the antenna is to be supported by a vertically disposed leg or a leg which is inclined with respect to vertical.

Assuming that the tower leg 12 is vertically disposed (FIG. 7A), bolt 66 will extend through the bolt openings in the inner ends of the support arms and will be positioned in bolt opening 42 in top portion 22 of upper mounting bracket 18. The inner ends of support arms 68 and 70 will be secured to lower mounting bracket 44 by means of bolt 72 extending through the bolt openings formed therein with the bolt 72 being positioned in bolt opening 60.

If the leg has a six-inch taper or angular inclination in twenty feet, bolt 66 will be positioned in bolt opening 40 and bolt 72 will be positioned in bolt opening 58 (FIG. 7B).

If the leg has a two-foot taper or inward inclination in twenty feet (FIG. 7C), bolt 66 will be positioned in bolt opening 42 in top portion 22 of upper mounting bracket 18 and bolt 72 will be positioned in bolt opening 58 in top portion 48 of lower mounting bracket 44.

The mounting brackets 18 and 44 with the bolt openings 40, 42 and 58, 60 formed therein, respectively, ensures that the pipes 80, and the antenna mounted thereon, may be positioned in a vertical plane regardless of whether the tower leg is vertically disposed or inclined at various angles with respect to vertical. Further, the pipes 82, and the antenna mounted thereon, will remain in a vertical plane if the antenna mounting pipe assembly is rotated with respect to the angled or tapered leg without the need of expensive adjustable brackets being required.

Figure 9:
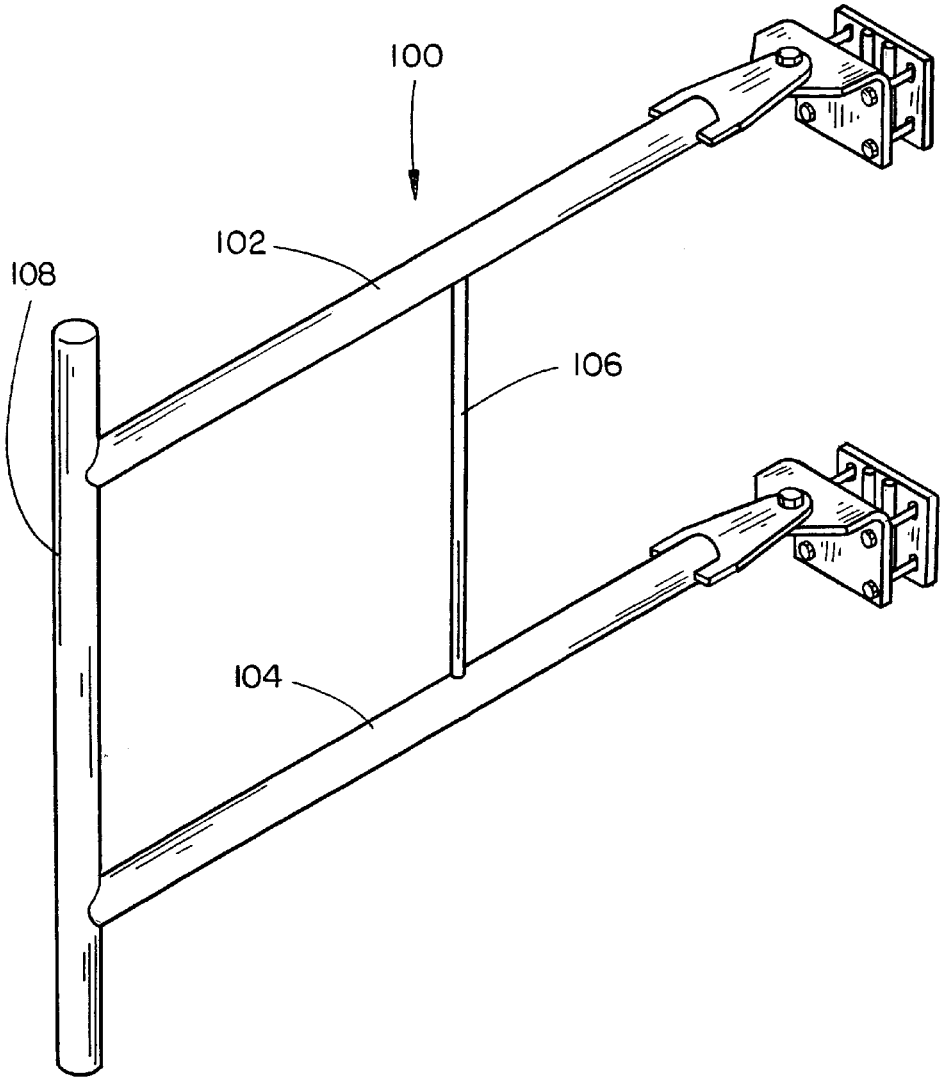
FIG. 9 is a perspective view of a modified form of the support arm assembly.

FIG. 9 illustrates a modified form of the support arm assembly which is designated by the reference numeral 100 and which replaces the support arm assemblies 61 and 61' when a single support arm assembly is utilized to support the antenna. The support arm assembly 100 is used with the same mounting brackets 18 and 44 to compensate for the slope or angle of the tower leg. Support arm assembly 100 includes an upper support arm 102 and a lower support arm 104 having a brace 106 extending therebetween. An antenna support 108 is provided at the outer ends of the arms 102 and 104, as seen in FIG. 9.

The inner ends of the support arms 102 and 104 are selectively connected to the mounting brackets 18 and 44 in the same manner as the support arms 62, 64 are connected to mounting bracket 18 and the support arms 68, 70 are connected to mounting bracket 44.

Thus it can be seen that the invention accomplishes at least all of its stated objectives.

I claim:

1. An antenna mounting bracket assembly for installation on either a first leg which is angled with respect to vertical or on a second leg which is vertically disposed, comprising:

an upper mounting bracket including a back portion, having upper and lower ends, and a top portion, having inner and outer ends, extending generally transversely from the upper end of said back portion;

said back portion of said upper mounting bracket being secured to one of said first and second legs;

said top portion of said upper mounting bracket having an inner bolt opening formed therein which is spaced from said inner end thereof a predetermined first distance;

said top portion of said upper mounting bracket having an outer bolt opening formed therein which is spaced from said inner end thereof a predetermined second distance;

a lower mounting bracket including a back portion, having upper and lower ends, and a top portion, having inner and outer ends, extending generally transversely from the upper end of said back portion;

said top portion of said lower mounting bracket having an inner bolt opening formed therein which is spaced from said inner end thereof a predetermined third distance;

said top portion of said lower mounting bracket having an outer bolt opening formed therein which is spaced from said inner end thereof a predetermined fourth distance;

said predetermined second and fourth distances being equal;

said predetermined first distance being greater than said predetermined third distance;

said back portion of said lower mounting bracket being secured to the same leg as said upper mounting bracket but positioned below said upper mounting bracket;

a first support arm assembly comprising first and second vertically spaced support arms having inner and outer ends;

a second support arm assembly comprising third and fourth vertically spaced support arms having inner and outer ends;

said inner ends of said first and third support arms being secured to said upper mounting bracket at said outer bolt opening thereof, when said upper mounting bracket is secured to said second leg;

said first and third support arms extending outwardly from said upper mounting bracket;

said inner ends of said second and fourth support arms being secured to said lower mounting bracket at said outer bolt opening thereof, when said lower mounting bracket is secured to said second leg;

said second and fourth support arms extending outwardly from said lower bracket in a diverging manner;

said inner ends of said first and third support arms being secured to said upper mounting bracket at said outer bolt opening when said upper mounting bracket is secured to a first leg which has a first angular relationship with respect to vertical;

said inner ends of said second and fourth support arms being secured to said lower mounting bracket at said inner bolt opening when said lower mounting bracket is secured to the first leg having the first angular relationship with respect to vertical;

said inner ends of said first and third support arms being secured to said upper mounting bracket at said inner bolt opening when said upper mounting bracket is secured to a first leg which has a second angular relationship with respect to vertical which is less than said first angular relationship;

said inner ends of said second and fourth support arms being secured to said lower mounting bracket at said inner bolt opening when said lower mounting bracket is secured to the first leg having the second angular relationship with respect to vertical which is less than said first angular relationship;

said outer ends of said first, second, third and fourth support arms adapted to have an antenna support mounted thereon with the selective connection of the support arms to the mounting brackets enabling an antenna mounted on the antenna support to be substantially vertically disposed regardless of whether the mounting brackets are mounted on vertically disposed or angularly disposed legs.

2. The antenna mounting bracket assembly of claim 1 wherein said first and second support arm assemblies are identical and reversible.

3. The antenna mounting bracket assembly of claim 2 wherein said inner ends of said support arms have a pivot plate secured thereto and wherein said outer ends of said support arms have angled mounting plates secured thereto.

4. The antenna mounting bracket assembly of claim 1 wherein a brace is secured to and extends between said first and second support arms and a brace is secured to and extends between said third and fourth support arms.

5. An antenna mounting bracket assembly for installation on either a first leg which is angled with respect to vertical or on a second leg which is vertically disposed, comprising:

an upper mounting bracket having inner and outer ends;

said upper mounting bracket being secured to one of said first and second legs;

said upper mounting bracket having an inner bolt opening formed therein which is spaced from said inner end thereof a predetermined first distance;

said upper mounting bracket having an outer bolt opening formed therein which is spaced from said inner end thereof a predetermined second distance;

a lower mounting bracket having inner and outer ends;

said lower mounting bracket having an inner bolt opening formed therein which is spaced from said inner end thereof a predetermined third distance;

said lower mounting bracket having an outer bolt opening formed therein which is spaced from said inner end thereof a predetermined fourth distance;

said predetermined second and fourth distances being equal;

said predetermined first distance being greater than said predetermined third distance;

said lower mounting bracket being secured to the same leg as said upper mounting bracket but positioned below said upper mounting bracket;

a first support arm assembly comprising first and second vertically spaced support arms having inner and outer ends;

a second support arm assembly comprising third and fourth vertically spaced support arms having inner and outer ends;

said inner ends of said first and third support arms being secured to said upper mounting bracket at said outer bolt opening thereof, when said upper mounting bracket is secured to said second leg;

said first and third support arms extending outwardly from said upper mounting bracket;

said inner ends of said second and fourth support arms being secured to said lower mounting bracket at said outer bolt opening thereof, when said lower mounting bracket is secured to said second leg;

said second and fourth support arms extending outwardly from said lower bracket in a diverging manner;

said inner ends of said first and third support arms being secured to said upper mounting bracket at said outer bolt opening when said upper mounting bracket is secured to a first leg which has a first angular relationship with respect to vertical;

said inner ends of said second and fourth support arms being secured to said lower mounting bracket at said inner bolt opening when said lower mounting bracket is secured to the first leg having the first angular relationship with respect to vertical;

said inner ends of said first and third support arms being secured to said upper mounting bracket at said inner bolt opening when said upper mounting bracket is secured to a first leg which has a second angular relationship with respect to vertical which is less than said first angular relationship;

said inner ends of said second and fourth support arms being secured to said lower mounting bracket at said inner bolt opening when said lower mounting bracket is secured to the first leg having the second angular relationship with respect to vertical which is less than said first angular relationship;

said outer ends of said first, second, third and fourth support arms adapted to have an antenna support mounted thereon with the selective connection of the support arms to the mounting brackets enabling an antenna mounted on the antenna support to be substantially vertically disposed regardless of whether the mounting brackets are mounted on vertically disposed or angularly disposed legs.

6. The antenna mounting bracket assembly of claim 5 wherein said first and second support arm assemblies are identical and reversible.

7. The antenna mounting bracket assembly of claim 6 wherein said inner ends of said support arms have a pivot plate secured thereto and wherein said outer ends of said support arms have angled mounting plates secured thereto.

8. The antenna mounting bracket assembly of claim 5 wherein a brace is secured to and extends between said first and second support arms and a brace is secured to and extends between said third and fourth support arms.

9. An antenna mounting bracket assembly for installation on either a first leg which is angled with respect to vertical or on a second leg which is vertically disposed, comprising:

an upper mounting bracket having inner and outer ends;

said upper mounting bracket being secured to one of said first and second legs;

said upper mounting bracket having an inner bolt opening formed therein which is spaced from said inner end thereof a predetermined first distance;

said upper mounting bracket having an outer bolt opening formed therein which is spaced from said inner end thereof a predetermined second distance;

a lower mounting bracket having inner and outer ends;

said lower mounting bracket having an inner bolt opening formed therein which is spaced from said inner end thereof a predetermined third distance;

said lower mounting bracket having an outer bolt opening formed therein which is spaced from said inner end thereof a predetermined fourth distance;

said predetermined second and fourth distances being equal;

said predetermined first distance being greater than said predetermined third distance;

said lower mounting bracket being secured to the same leg as said upper mounting bracket but positioned below said upper mounting bracket;

a support arm assembly comprising first and second vertically spaced support arms having inner and outer ends;

said inner end of said first support arm being secured to said upper mounting bracket at said outer bolt opening thereof, when said upper mounting bracket is secured to said second leg;

said inner end of said second support arm being secured to said lower mounting bracket at said outer bolt opening thereof, when said lower mounting bracket is secured to said second leg;

said first and second support arms extending outwardly from said upper and lower mounting brackets;

said inner end of said first support arm being secured to said upper mounting bracket at said outer bolt opening when said upper mounting bracket is secured to a first leg which has a first angular relationship with respect to vertical;

said inner end of said second support arm being secured to said lower mounting bracket at said inner bolt opening when said lower mounting bracket is secured to the first leg having the first angular relationship with respect to vertical;

said inner end of said first support arm being secured to said upper mounting bracket at said inner bolt opening when said upper mounting bracket is secured to a first leg which has a second angular relationship with respect to vertical which is less than said first angular relationship;

said inner end of said second support arm being secured to said lower mounting bracket at said inner bolt opening when said lower mounting bracket is secured to the first leg having the second angular relationship with respect to vertical which is less than said first angular relationship;

said outer ends of said first and second support arms adapted to have an antenna mounted thereon with the selective connection of the support arms to the mounting brackets enabling an antenna mounted thereon to be substantially vertically disposed regardless of whether the mounting brackets are mounted on vertically disposed or angularly disposed legs.

* * * * *